US005190016A

United States Patent [19]

Takeda

[11] Patent Number: 5,190,016

[45] Date of Patent: Mar. 2, 1993

[54] SUPERCHARGED ENGINE

[75] Inventor: Toshio Takeda, Mizuho, Japan

[73] Assignee: Aisin Seiki Kabushiki Kaisha, Kariya, Japan

[21] Appl. No.: 766,262

[22] Filed: Sep. 27, 1991

[30] Foreign Application Priority Data

Sep. 27, 1990 [JP] Japan ..... 2-257963

[51] Int. Cl.[5] ..... F02B 33/38

[52] U.S. Cl. ..... 123/564

[58] Field of Search ..... 60/611; 123/564

[56] References Cited

U.S. PATENT DOCUMENTS 4,062,333 12/1977 Matsuda et al. ..... 123/564

4,815,437 3/1989 Regar ..... 123/564

FOREIGN PATENT DOCUMENTS 29734 2/1987 Japan ..... 123/564

92524 4/1989 Japan ..... 123/564

*Primary Examiner*—Michael Koczo

*Attorney, Agent, or Firm*—Oblon, Spivak, McClelland, Maier & Neustadt

[57] ABSTRACT

A supercharged engine includes an intake passage, an engine located at one end of the intake passage, an air cleaner located at the other end of the intake passage, a mechanical supercharger located in the intake passage, a main throttle valve located at a downstream side of the intake passage, a sub throttle valve located at an upstream side of the intake passage so as to be larger than the main throttle valve in the opening ratio and linked with the main throttle valve. A relief passage, in parallel to the intake passage, is located between a downstream space between the mechanical supercharger and the main throttle valve and an upstream space between the mechanical supercharger and the sub throttle valve, and a relief valve located in the relief passage and responsive to a pressure-difference across the main throttle valve.

9 Claims, 3 Drawing Sheets

SUPERCHARGED ENGINE

BACKGROUND OF THE INVENTION

1. Field of the Invention

The present invention relates to a supercharged engine and more particularly to a supercharged engine having main and sub throttle valves for a motor vehicle.

2. Description of the Related Art

In general, a supercharged engine is used as a driving source of a motor vehicle and is located at one end of an intake passage. An air cleaner is located at the other end of the intake passage. A mechanical supercharger is located in the intake passage. A throttle valve is located at a downstream side of the mechanical supercharger in the intake passage.

In the above-mentioned supercharged engine, when the throttle valve is suddenly shut, for example when the motor vehicle speed is reduced, the pressure between the mechanical supercharger and the throttle valve in the intake passage is suddenly increased. As a result, the high pressure caused in the intake passage has a negative influence on the mechanical supercharger and throttle valve.

For the prevention of such drawback, in a supercharged engine shown in Japanese Patent Laid-open No. 62(1987)-29734, a main throttle valve is located at a downstream side of a mechanical supercharger in an intake passage, and a sub throttle valve is located at an upstream side of the mechanical supercharger in the intake passage.

In the above construction, when the main throttle valve is closed, the sub throttle valve is also closed at the same time. Thus, intake air is not supplied to the mechanical supercharger, so that the pressure between the mechanical supercharger and the main throttle valve in the intake passage is not increased. However, a large negative pressure is caused between the sub throttle valve and the mechanical supercharger in the intake passage. Therefore, the large negative pressure also negatively influences the mechanical supercharger and the sub throttle valve.

SUMMARY OF THE INVENTION

Accordingly, it is a primary object of the present invention to prevent generating an abnormal pressure in an intake passage.

The above and other objects are achieved according to the present invention by a supercharged engine which comprises an intake passage, an engine located at one end of the intake passage, an air cleaner located at the other end of the intake passage so that air flows in an upstream to downstream direction through the intake passage from the air cleaner to the engine, a mechanical supercharger located in the intake passage, a main throttle valve located at a downstream side of the intake passage, a sub throttle valve located at an upstream side of the intake passage so as to be larger than the main throttle valve in the opening ratio and linked with the main throttle valve, a relief passage, in parallel to the intake passage, located between a downstream space between the mechanical supercharger and the main throttle valve and an upstream space between the mechanical supercharger and the sub throttle valve, and a relief valve located in the relief passage and responsive a pressure-difference across the main throttle valve.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings wherein.

DETAILED DESCRIPTION OF THE PREFERRED EMBODIMENTS

Figure 1:
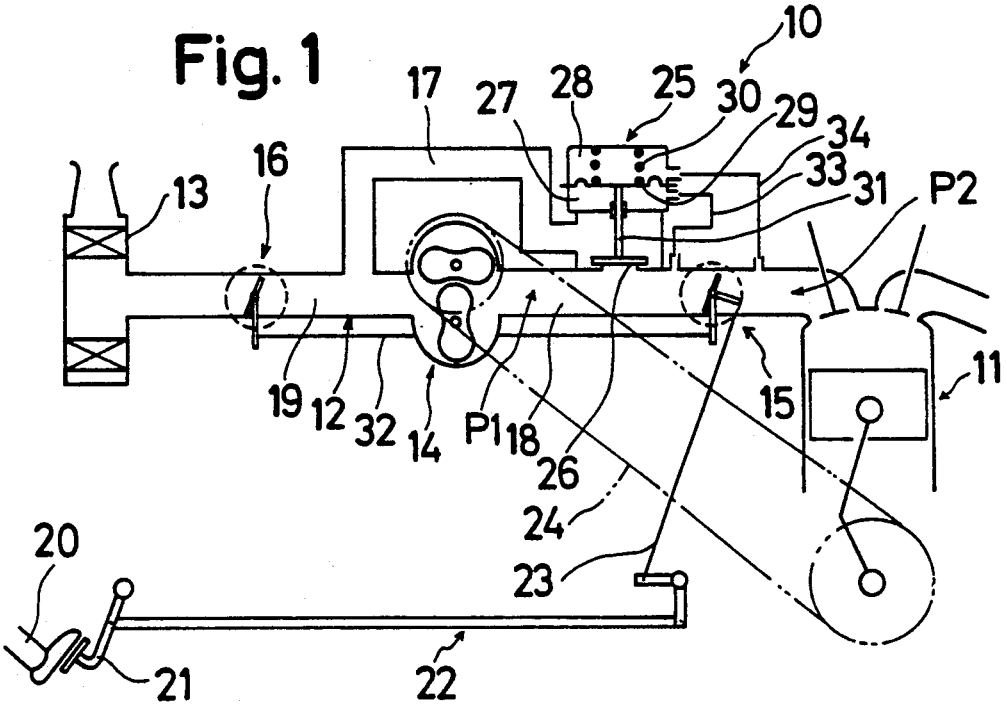
FIG. 1 is a view of an overall structure of a supercharge engine according to the first embodiment of the invention.

Referring to FIG. 1, a supercharged engine system 10 is shown. Here, the engine 11 is used as a driving source of a motor vehicle (not shown), for example. The engine 11 is located at one end of an intake passage 12. An air cleaner 13 is located at the other end of the intake passage 12. A mechanical supercharger 14 is located in the intake passage 12, and is driven by the engine 11 via a belt 24.

A main throttle valve 15 is located at a downstream side of the mechanical supercharger 14 in the intake passage 12. A sub throttle valve 16 is located at an upstream side of the mechanical supercharger 14 in the intake passage 12. The main throttle valve 15 is driven by an operator 20 via an accelerator 21, a mechanical link 22 and a wire 23. A wire or a mechanical link 32 connects the main throttle valve 15 and the sub throttle valve 16.

A relief passage 17 connects a space 18 and a space 19 in the intake passage 12. The space 18 is formed between the supercharger 14 and the main throttle valve 15. The space 19 is formed between the supercharger 14 and the sub throttle valve 16. A relief valve 25 is located at an end of the relief passage 17 closest to the space 18. A valve 26 controls the communicating condition between the relief passage 17 and the space 18. A pressure Pl in the space 18 is introduced into a first chamber 27 via a line 33. A pressure P2 at a downstream side of the main throttle valve 15 is introduced into a second chamber 28 via a line 34. A diaphragm 29 is set to divide or separate the first chamber 27 and the second chamber 28, and is fixed with a rod 31 secured to the valve 26. A spring 30 is located in the second chamber 28 and acts in the direction of the closure of the valve 26.

Figure 2:
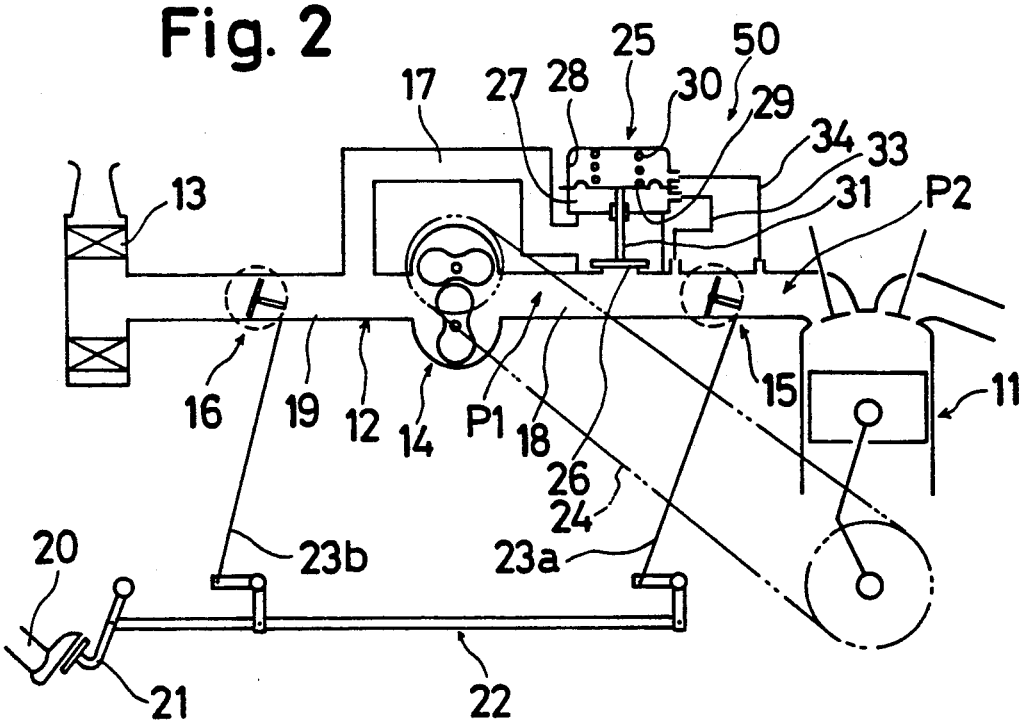
FIG. 2 is a view of an overall structure of a supercharged engine according to the second embodiment of the invention.

Next, referring to FIG. 2, which shows a supercharged engine 50 of a second embodiment according to the present invention, only the construction different from the first embodiment will be described hereinafter.

The main throttle valve 15 is driven by the operator 20 via the accelerator 21, the mechanical link 22 and the wire **23*a*, and the sub throttle valve 16 is driven by the operator 20 via the accelerator 21, the mechanical link 22 and the wire 23***b*.

Figure 3:
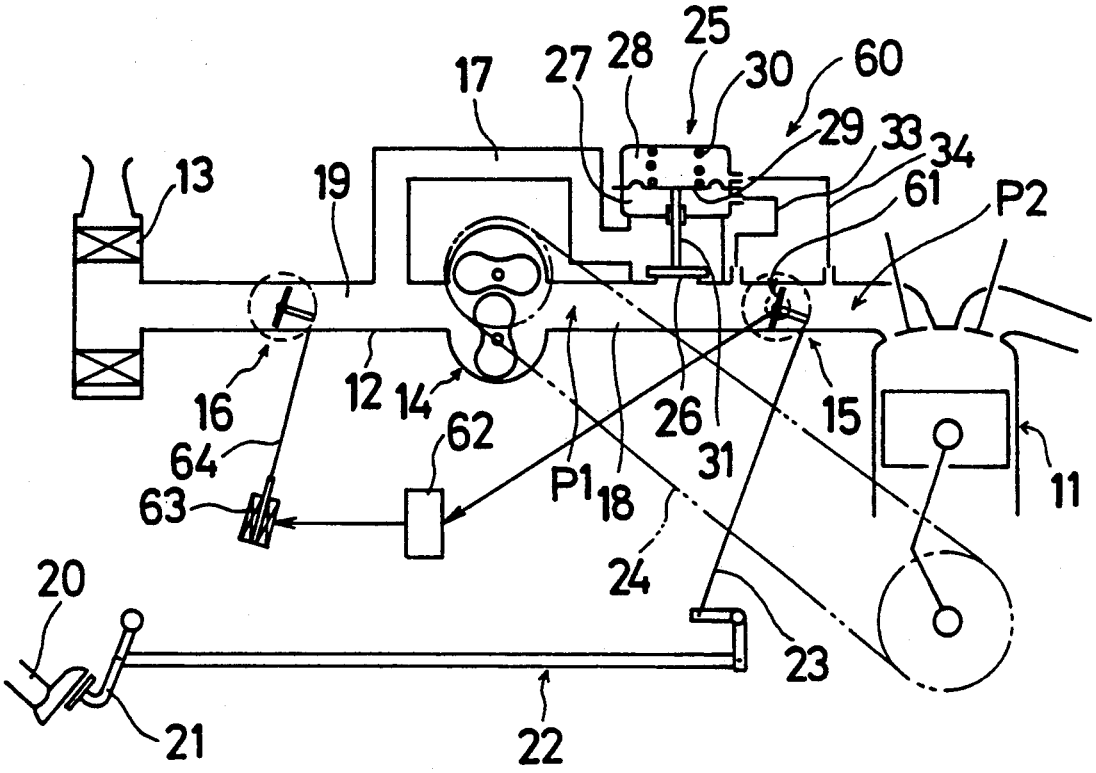
FIG. 3 is a view of an overall structure of a supercharged engine according to the third embodiment of the invention.

Next, referring to FIG. 3, which shows a supercharged engine 60 of a third embodiment according to the present invention, only the construction different from the first embodiment will be described hereinafter.

An opening ratio of the main throttle valve 15 (i.e., the degree of opening as a percentage of the fully opened position; see FIGS. 4–7) is checked by an opening ratio sensor 61. An output signal of the opening ratio sensor 61 is inputted into a central processing unit 62. The central processing unit 62 controls a degree of opening of the sub throttle valve 16 via a solenoid means 63 and a wire 64.

In each of the above-mentioned first, second and third embodiments, the mechanical supercharger 14 is driven by the engine 11 via the belt 24. The rotational speed of the engine 11 is controlled by the operator 20 via the main throttle valve 15.

Here, the sub throttle valve 16 linked with the main throttle valve 15 is controlled according to the characteristic charts shown in FIGS. 4, 5, 6 and 7. In FIGS. 4, 5, 6 and 7, the opening ratio of the main throttle valve 15 is changed as shown in 2-dotted line L1 and the opening ratio of the sub throttle valve 16 (solid line) is always larger than the opening ratio of the main throttle valve 15.

Figure 4:
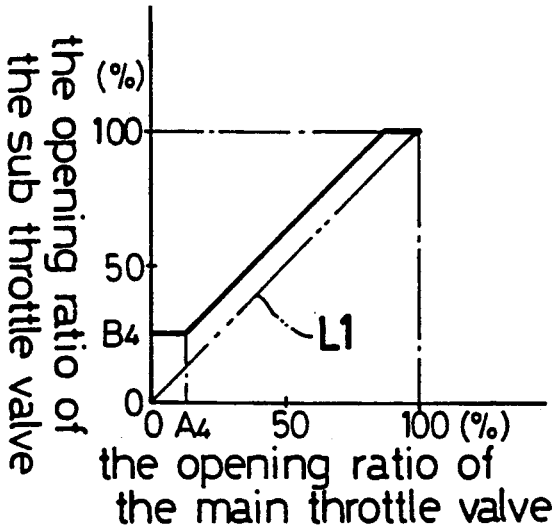
FIG. 4 is a first characteristic chart of a supercharged engine according to the invention.

First, with respect to the characteristic chart shown in FIG. 4, when the opening ratio of the main throttle valve 15 is smaller than a first set opening ratio A4, the opening ratio of the sub throttle valve 16 is held constant at a second set opening ratio B4. On the other hand, when the opening ratio of the main throttle valve 15 is larger than the first set opening ratio A4, the opening ratio of the sub throttle valve 16 increases in proportion to the opening ratio of the main throttle valve 15.

Figure 5:
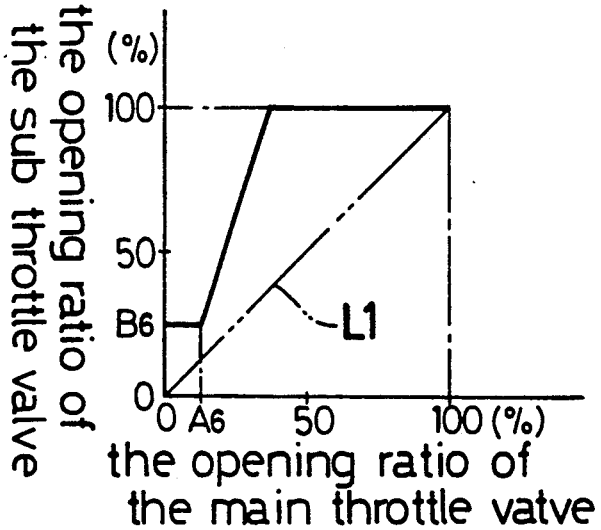
FIG. 5 is a second characteristic chart of a supercharged engine according to the invention.

Second, with respect to the characteristic chart shown in FIG. 5, when the opening ratio of the main throttle valve 15 is smaller than a first set opening ratio A5, the opening ratio of the sub throttle valve 16 is held constant at a second set opening ratio B5. On the other hand, when the opening ratio of the main throttle valve 15 is larger than the first set opening ratio A5, an increasing ratio of the opening ratio of the sub throttle valve 16 is larger than an increasing ratio of the opening ratio of the main throttle valve 15.

Figure 6:
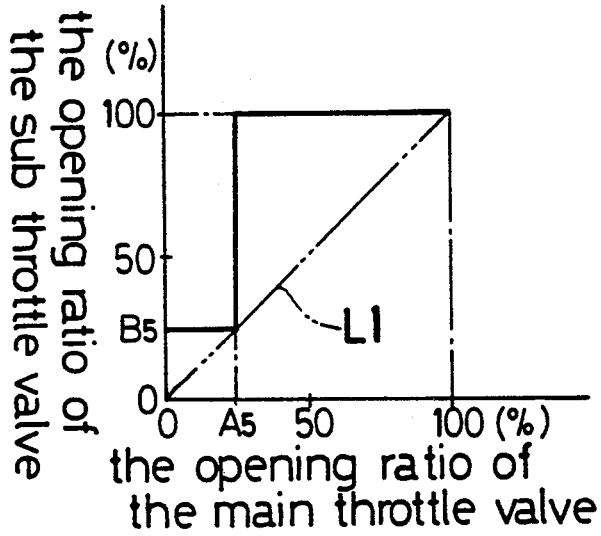
FIG. 6 is a third characteristic chart of a supercharged engine according to the invention.

Third, with respect to the characteristic chart shown in FIG. 6, when the opening ratio cf the main throttle valve 15 is smaller than a first set opening ratio A6, the opening ratio of the sub throttle valve 16 is held constant at a second set opening ratio B6. On the other hand, when the opening ratio of the main throttle valve 15 is larger than the first set opening ratio A6, the sub throttle valve 16 is opened fully.

Figure 7:
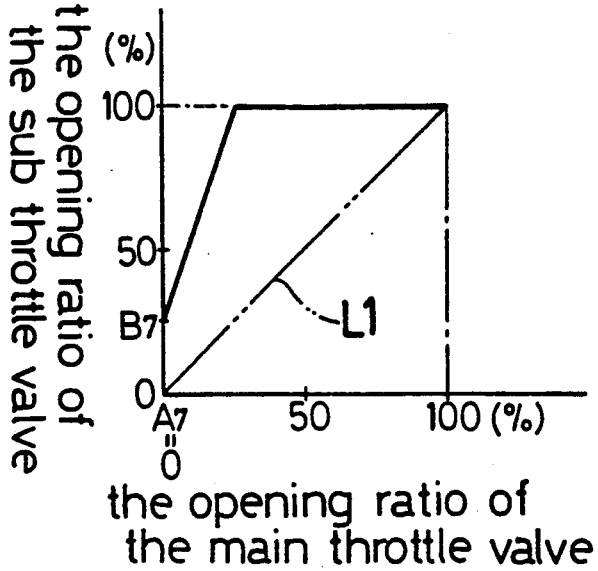
FIG. 7 is a fourth characteristic chart of a supercharged engine according to the invention.

Finally, with respect to the characteristic chart shown in FIG. 7, when the opening ratio of the main throttle valve 15 is smaller than a first set opening ratio A7 (=0%), the opening ratio of the sub throttle valve 16 is held at a second set opening ratio B7. On the other hand, when the opening ratio of the main throttle valve 15 is larger than the first set opening ratio A7 (=0%), an increasing ratio of the opening ratio of the sub throttle valve 16 is larger than an increasing ratio of the opening ratio of the main throttle valve 15.

In the above-mentioned four characteristic charts, when the main throttle valve 15 is closed fully, the opening ratio of the sub throttle valve 16 is kept at the opening ratio B4, B5, B6, B7, each of which is not 0%. So, when the main throttle valve 15 is closed fully, the intake air corresponding to the opening ratio B4, B5, B6, B7 of the sub throttle valve 16 is supplied to the mechanical supercharger 14. Therefore, negative pressure is not caused between the sub throttle valve 16 and the mechanical supercharger 14 in the intake passage 12.

Further, the relief valve 25 acts when the pressure P1 is over the set pressure value, namely, when the pressure P1 introduced into the first chamber 27 is over the total of the pressure P2 introduced into the second chamber 28 and the urging force of the spring 30, the diaphragm 29, rod 31 and the valve 26 move upwardly, and the relief passage 17 is in fluid communication with the space 18. Therefore, unnecessary supercharging pressure is not supplied to the engine 11, and when the main throttle valve 15 is suddenly shut, the pressure of the space 18 is not suddenly increased and the dose not become high pressure. Here, the opening ratio of the sub throttle valve 16 is small, so that the quantity of the intake air discharged from the mechanical supercharger 14 is also small. Thus, the capacity of the relief passage 17 and relief valve 25 can be small.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A supercharged engine comprising:

an intake passage;

an engine located at one end of the intake passage;

an air cleaner at another end of the intake passage, whereby air flows through the intake passage in an upstream to downstream direction from the air cleaner to the engine;

a mechanical supercharger located in the intake passage;

a main throttle valve located at a downstream side of the intake passage;

a sub throttle valve located at an upstream side of the intake passage, the sub throttle valve having an opening ratio which is larger than an opening ratio of the main throttle valve, wherein the sub throttle valve is linked with the main throttle valve;

a relief passage, in parallel to the intake passage, located between a downstream space between the mechanical supercharger and the main throttle valve and an upstream space between the mechanical supercharger and the sub throttle valve; and a relief valve located in the relief passage and having means responsive to a pressure-difference across the main throttle valve.

2. A supercharged engine as set forth in claim 1, wherein when the opening ratio of the main throttle valve is smaller than a first set opening ratio, the opening ratio of the sub throttle valve is held at a second set opening ratio.

3. A supercharged engine as set forth in claim 2, wherein when the opening ratio of the main throttle valve is larger than the first set opening ratio, the opening ratio of the sub throttle valve increases in proportion to the opening ratio of the main throttle valve.

4. A supercharged engine as set forth in claim 2, wherein an increasing ratio of the opening ratio of the sub throttle valve is larger than an increasing ratio of the opening ratio of the main throttle valve.

5. A supercharged engine as set forth in claim 2, wherein when the opening ratio of the main throttle is larger than the first set opening ratio, the sub throttle valve is opened fully.

6. A supercharged engine as set forth in claim 2, wherein the first set opening ratio is 0%.

7. A supercharged engine as set forth in claim 2, wherein the sub throttle valve is linked with the main throttle valve via a mechanical link.

8. A supercharged engine as set forth in claim 2, wherein the sub throttle valve is linked with the main throttle valve via an electrical linking means which comprises:

an opening ratio sensor, a central processing unit for receiving an outputted signal of the opening ratio sensor, and a solenoid means for controlling the opening ratio of the sub throttle valve under the control of the central processing unit.

9. A supercharged engine comprising:

an intake passage;

an engine located at one end of the intake passage;

an air cleaner located at another end of the intake passage, whereby air flows through the intake passage in an upstream to downstream direction from the air cleaner to the engine;

a mechanical supercharger located in the intake passage;

a main throttle valve located at a downstream side of the intake passage;

a sub throttle valve located at an upstream side of the intake passage and linked with the main throttle valve;

a relief passage, in parallel to the intake passage, located between a downstream space between the mechanical supercharger and the main throttle valve and an upstream space between the mechanical supercharger and sub throttle valve; and a relief valve located in the relief passage and having means responsive to a pressure difference between an upstream side of the main throttle valve and a downstream side thereof;

wherein an opening ratio of the sub throttle valve is always larger than an opening ratio of the main throttle valve, wherein when an opening ratio of the main throttle valve is smaller than a first set opening ratio, the opening ratio of the sub throttle vale is held at a second set opening ratio, and wherein when the opening ratio of the main throttle valve is larger than first set opening ratio, the opening ratio of the sub throttle valve increases in proportion to the opening ratio of the main throttle valve.

* * * * *

UNITED STATES PATENT AND TRADEMARK OFFICE

CERTIFICATE OF CORRECTION

PATENT NO. : 5,190,016

DATED : March 2, 1993

INVENTOR(S) : TOSHIO TAKEDA

It is certified that error appears in the above-identified patent and that said Letters Patent is hereby corrected as shown below:

Column 4:
Claim 1, line 35, after "cleaner" insert --located--.

Signed and Sealed this

Twenty-second Day of February, 1994

*Attest:*

Bruce Lehman

BRUCE LEHMAN

*Attesting Officer*

*Commissioner of Patents and Trademarks*